US007293786B2

(12) United States Patent
Burton et al.

(10) Patent No.: US 7,293,786 B2
(45) Date of Patent: Nov. 13, 2007

(54) ROOM SERVICE TABLE

(75) Inventors: David J. Burton, Woodbury, MN (US); Gary W. Andert, Rosemount, MN (US); Richard C. Bue, Eden Prairie, MN (US)

(73) Assignee: Sico Incorporated, Edina, MN (US)

( * ) Notice: Subject to any disclaimer, the term of this patent is extended or adjusted under 35 U.S.C. 154(b) by 323 days.

(21) Appl. No.: 10/958,636

(22) Filed: Oct. 4, 2004

(65) Prior Publication Data

US 2006/0070556 A1 Apr. 6, 2006

(51) Int. Cl.
*B62B 3/02* (2006.01)

(52) U.S. Cl. ..... 280/47.371; 403/348; 403/354

(58) Field of Classification Search ..... 280/47.36, 280/47.371; 403/348, 349, 353, 354, 359
See application file for complete search history.

(56) References Cited

U.S. PATENT DOCUMENTS

| | | | | |
|---|---|---|---|---|
| 1,582,045 | A | | 4/1926 | Howe |
| 1,828,248 | A | | 10/1931 | Hallowell et al. |
| 2,571,442 | A | | 10/1951 | Griffith |
| 2,576,287 | A | * | 11/1951 | English ..... 108/78 |
| 2,603,500 | A | | 7/1952 | Messier |
| 3,017,217 | A | * | 1/1962 | Keating ..... 296/97.13 |
| 3,203,707 | A | | 8/1965 | Anderson |
| 3,649,997 | A | | 3/1972 | Thorud |
| 3,816,873 | A | | 6/1974 | Thorud et al. |
| 3,920,259 | A | | 11/1975 | Graham |
| 4,160,557 | A | | 7/1979 | Taylor |
| 4,362,308 | A | | 12/1982 | Hicks et al. |
| 4,581,902 | A | | 4/1986 | Starck et al. |
| 4,724,681 | A | | 2/1988 | Bartholomew et al. |
| 4,796,909 | A | | 1/1989 | Kirkendall |
| 4,846,493 | A | | 7/1989 | Mason |
| 4,856,810 | A | | 8/1989 | Smith |
| 4,875,696 | A | | 10/1989 | Welch et al. |

(Continued)

FOREIGN PATENT DOCUMENTS

| | | |
|---|---|---|
| GB | 455281 | 10/1936 |

OTHER PUBLICATIONS

T-S Folding Table, 3 pages (Date Unknown).

(Continued)

*Primary Examiner*—Christopher P. Ellis
*Assistant Examiner*—John D Walters
(74) *Attorney, Agent, or Firm*—Merchant & Gould P.C.

(57) ABSTRACT

A room service table includes a frame, a tabletop including folding side portions and wheels. A push handle assembly mounts to an underside of the table and includes a handle portion and a hinge body portion. The handle portion includes a grip, a support portion and a hinge pin portion. The hinge body mounts to the tabletop and includes barrel portions supporting the hinge pin portion. The hinge pin portion has a tab formed in an end thereof engaging a complementary slot formed in the hinge body portion. The slot includes a first section and a second section that receive and retain the tab for aligning and securing the handle at the use position and at the storage position. The biasing member urges the pin toward the slot. Rotation is accomplished by sliding the handle axially so that the tab disengages the slot and rotating the handle to the desired position and then releasing the handle.

23 Claims, 6 Drawing Sheets

U.S. PATENT DOCUMENTS

| | | | | |
|---|---|---|---|---|
| 5,183,372 | A | 2/1993 | Dinverno | |
| 5,299,826 | A | 4/1994 | Flowers | |
| 5,306,029 | A | 4/1994 | Kaiser, II | |
| 5,423,651 | A | 6/1995 | Dinverno | |
| 5,431,298 | A | 7/1995 | Ahn et al. | |
| 5,562,300 | A | 10/1996 | Nelson | |
| 5,593,174 | A | 1/1997 | Graziano et al. | |
| 5,628,522 | A | 5/1997 | Hall | |
| 5,687,978 | A | 11/1997 | Rhodes et al. | |
| 5,692,761 | A | 12/1997 | Havlovitz | |
| 5,806,933 | A * | 9/1998 | Tsui et al. | 297/391 |
| 5,868,533 | A * | 2/1999 | Fiala | 408/226 |
| 5,871,222 | A * | 2/1999 | Webb | 280/511 |
| 5,876,047 | A | 3/1999 | Dennis | |
| 6,010,145 | A | 1/2000 | Liu | |
| 6,354,611 | B1 | 3/2002 | Mihalic et al. | |
| 6,802,525 | B2 * | 10/2004 | Smith | 280/659 |
| 6,840,526 | B2 * | 1/2005 | Anderson et al. | 280/166 |
| 6,925,944 | B1 * | 8/2005 | Miller et al. | 108/115 |
| 2003/0047914 | A1 | 3/2003 | Smith | |
| 2003/0214107 | A1 | 11/2003 | Fernandez | |

OTHER PUBLICATIONS

SICO Room Service Tables, 2 pages (Oct. 2000).
SICO Socializer Mobile Folding Table, 1 page (Date Unknown).
Mobile Folding Room Service Table. Tables that Move as Fast as Your Business, http://www.sicoinc.com/room_service_table.php, 2 pages (Date Printed Sep. 15, 2006).
SICO Seminar Mobile Folding Table, 1 page (Date Unknown).
SICO Mobile Folding Catering Tables, 1 page (Date Unknown).
SICO LB Mobile Folding Table, 1 page (Date Unknown).
SICO Mobile Folding Banquet Tables, 4 pages (2004).
SICO Catering Tables Single-Tier and Two-Tier, 4 pages (Aug. 2004).
Installation Instructions for Stabilizer Bar and Replacement Parts List LB Table, 2 pages (Nov. 2000).
SICO Room Service Table, Model No. TRU3, 1 page (Oct. 2002).
SICO Pacer Table Operating Instructions and Parts List, 2 pages (Apr. 2003).
SICO Socializer Table Operating Instructions, 1 page (Nov. 2002).

* cited by examiner

ROOM SERVICE TABLE

BACKGROUND OF THE INVENTION

1. Field of the Invention

The present invention relates to a room service table and in particular to a room service table with a push handle that rotates between a use position and a hidden storage position.

2. Prior Art

Room service tables are well known and widely used in hotels, cruise ships and other applications where food is served to guests at locations remote from a dining room. The wheeled tables typically serve not only as a transport for the food, but also serve as a dining surface where meals may be served.

For some models, room service tables are equipped with a handle that is used to push or pull the table. However, such handles are typically located at an elevation that is not sufficiently high for comfortably pushing or pulling the table. Therefore, the server must bend over in order to grip the handle and move the table, thereby causing strain on the server's back and/or arms. Moreover, a handle protruding outward limits the utility of the table when used as a dining surface and is not aesthetically pleasing.

To address these problems, a table has been developed that includes a handle that pivots between a use position and a storage position. Such a table is disclosed in U.S. Published Patent Application No. 2003/0047914 to Smith. The Smith table provides a handle that allows for pushing in an ergonomically correct manner that reduces strain on the user's back and arms. Although the Smith table provides several advantages over the prior art and addresses problems associated with a handle that provides for comfortable pushing while folding to a storage position, still further improvements are possible. The Smith table requires locking pins to maintain the handle at both the use position and the storage position. Such pins are not aesthetically pleasing and also may be difficult to align and insert. When alignment causes additional effort, workers may not take the time to use the pins and the handle may not be used and may not be maintained at the preferred positions.

It can be seen that a room service table with a handle that can be moved between a use position and a storage position and that automatically locks in both the use and storage position is needed. Such a table and handle should provide for easily moving the handle so that it may be locked or unlocked, as well as providing an aesthetically pleasing table and handle. Moreover, such a handle should not require moving and inserting pins that must be precisely aligned. The present invention addresses these, as well as other problems associated with room service tables with handles.

SUMMARY OF THE INVENTION

The present invention is directed to a room service table and in particular to a room service table having a push handle mounted thereto. The push handle rotates between a use position where it extends upward and outward from the table and a storage position underneath the tabletop.

Room service tables generally include a tabletop supported by a framework and are mounted on wheels or casters. The tabletop may include side portions that drop down for transport and storage, but fold upward to a horizontally extending position to provide a larger dining surface.

The handle assembly includes a handle portion having two side-by-side handgrips and a support portion leading down to the hinge. The handle rotates from a hinge body mounting to the underside of the tabletop. The hinge body includes two mounting members having barrel portions that form the body of the hinge receiving the hinge portion of the handle.

The hinge pin portion slidably and rotatably mounts in the hinge body. One of the body members includes a slot having two substantially rectangular connected sections angled toward one another. A tab at the end of the hinge body is complementary to the slot and seats in one or the other of the rectangular sections of the slot. A spring mounted in the other body member engages and biases the hinge pin portion toward the slot. A tab in the end of the hinge pin portion engages and seats in one of the complementary slot sections at the use position. The tab is biased into and engages the storage section of the slot while at the storage position. The slot sections and the tab align the handle for both storage and use.

Rotation is accomplished by disengaging the tab from the slot. The handle hinge portion slidably mounts in the body so that the handle may be slid axially until the tab disengages. The handle is then freely rotatable to move between the use position and the storage position. When the handle is properly aligned at either position, the handle is released and the spring pushes the tab to engage the slot so that the handle is securely retained and properly aligned.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

Figure 1:
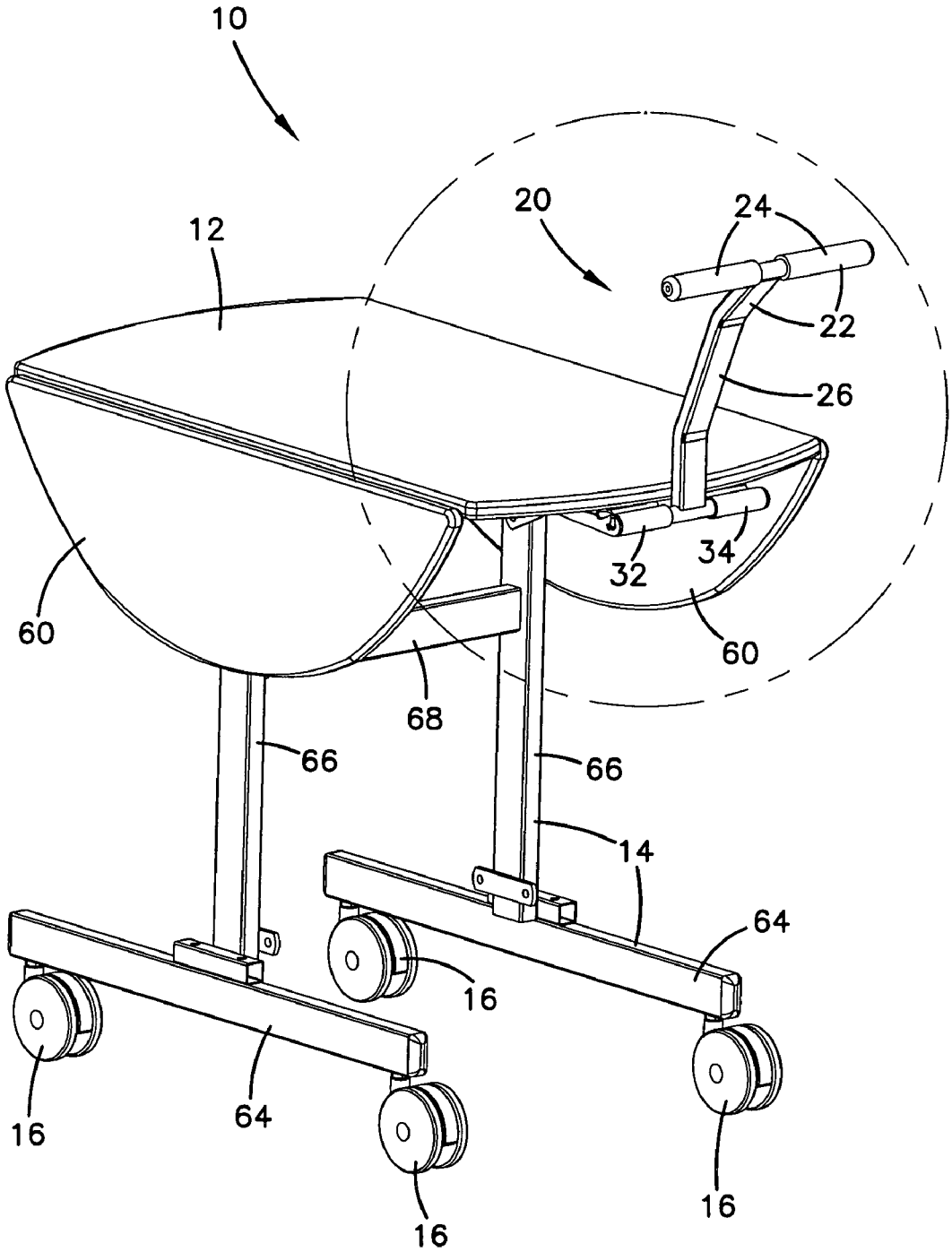
FIG. 1 is a perspective view of a room service table according to the principles of the present invention.
Figure 2:
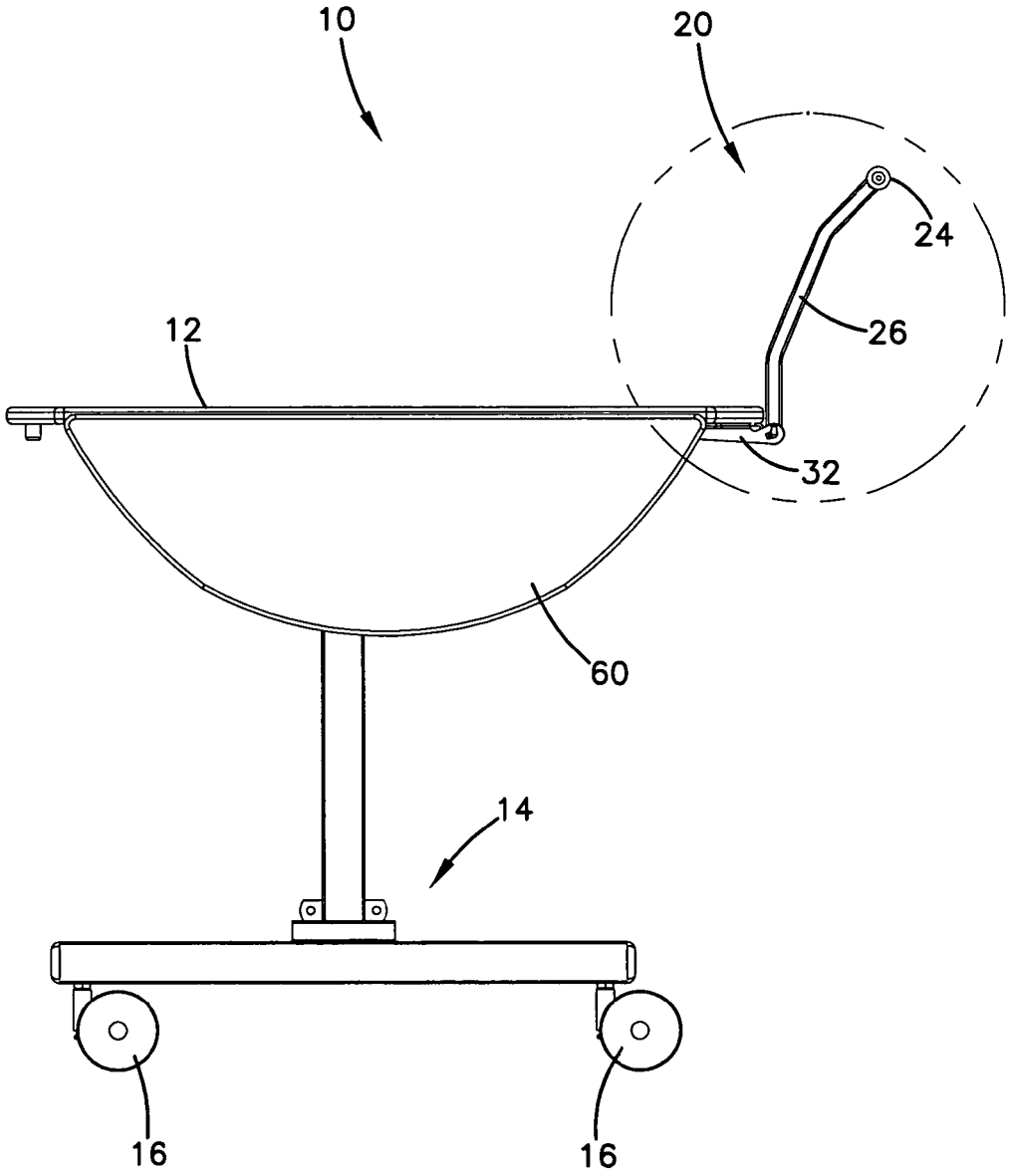
FIG. 2 is a side elevational view of the room service table shown in FIG. 1.
Figure 5:
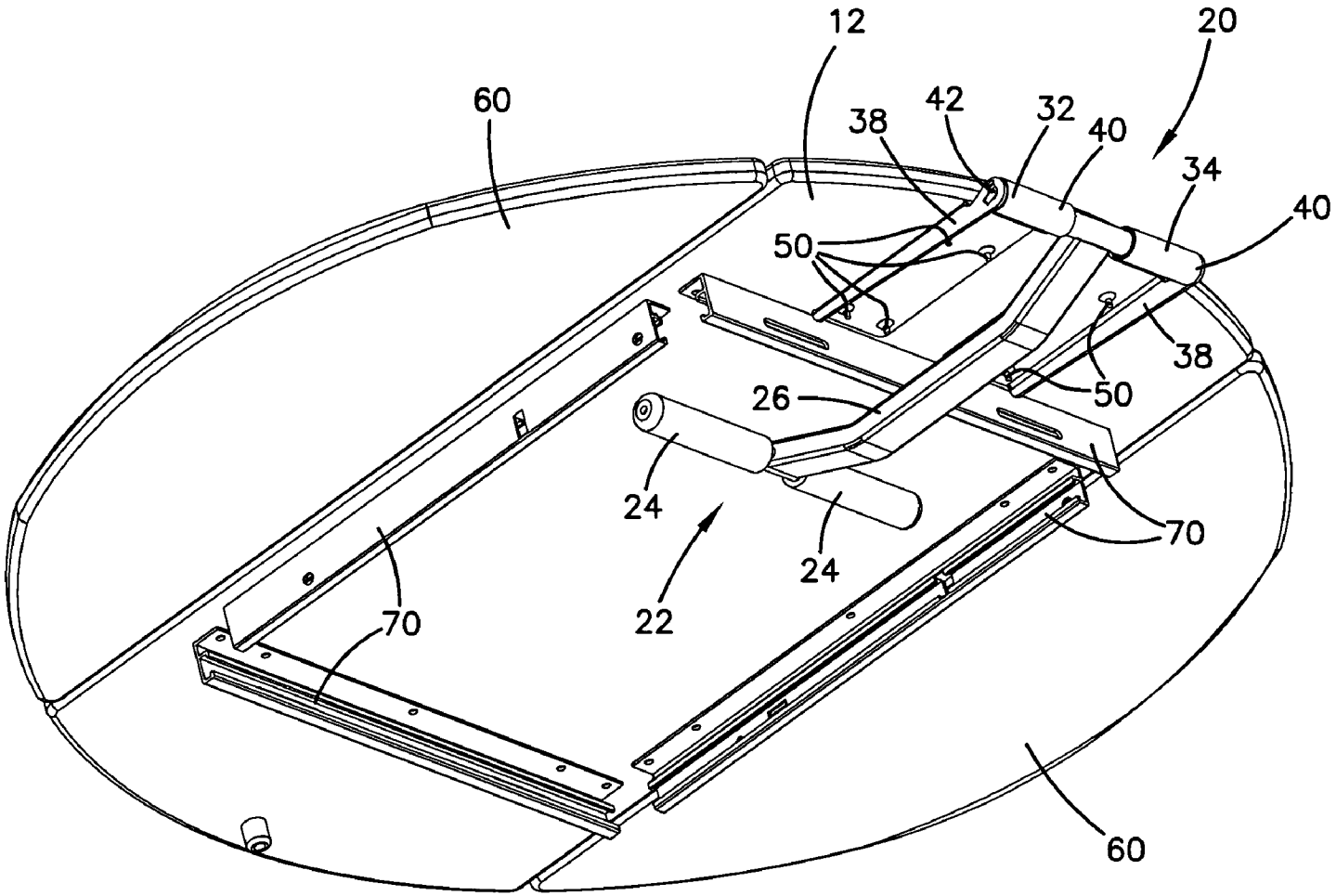
FIG. 5 is a detail perspective view of the handle assembly shown in FIG. 3 with handle at the storage position.

Referring now to the drawings and in particular to FIGS. 1 and 2, there is shown a portable worn service table, generally designated 10. Room service tables are well known and are utilized for delivering meals while also providing a dining surface. Room service tables 10 generally include a frame 14 mounted on casters or wheels 16 and supporting a tabletop 12. The tabletop 12 may include folding side portions 60 that fold down for transport and storage, or fold up to a horizontally extending position for use. The tabletop 12 is shown forming a generally oval tabletop surface, but rectangular tabletops and other well-known shapes are also foreseen with the present invention. The frame 14 generally includes lower base portions 64, risers 66 and a cross member 68. In addition, as shown in FIG. 5, the tabletop 12 includes supporting frame member 70. Some room service tables will also include a lower frame portion (not shown) for supporting portable food warmers. To provide for nesting while stored, the tabletop 12 folds to a substantially vertical orientation by a folding assembly 62, shown in FIG. 3.

Figure 3:
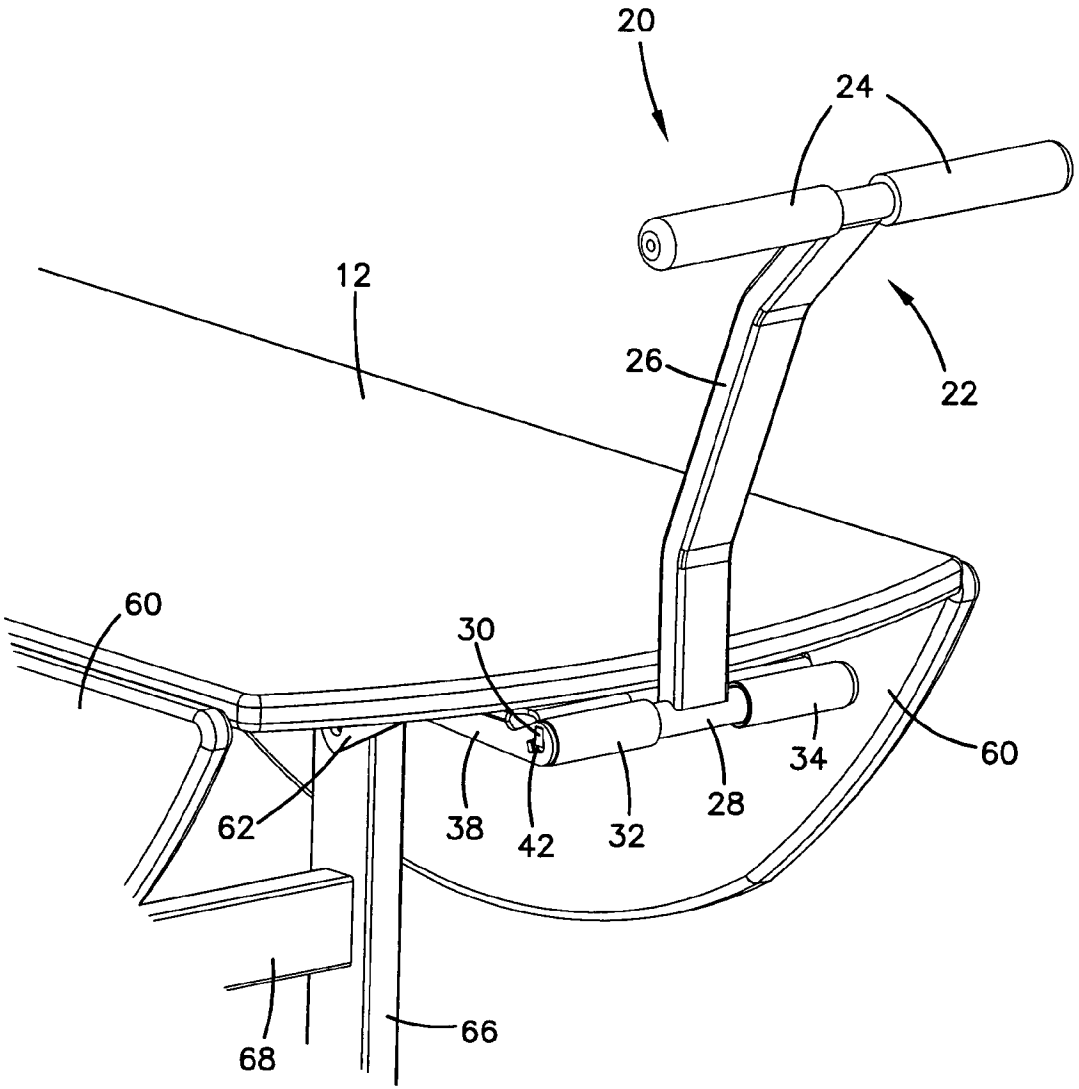
FIG. 3 is a detail perspective view of the handle assembly for the room service table shown in FIG. 1 with the handle at the use position.
Figure 7:
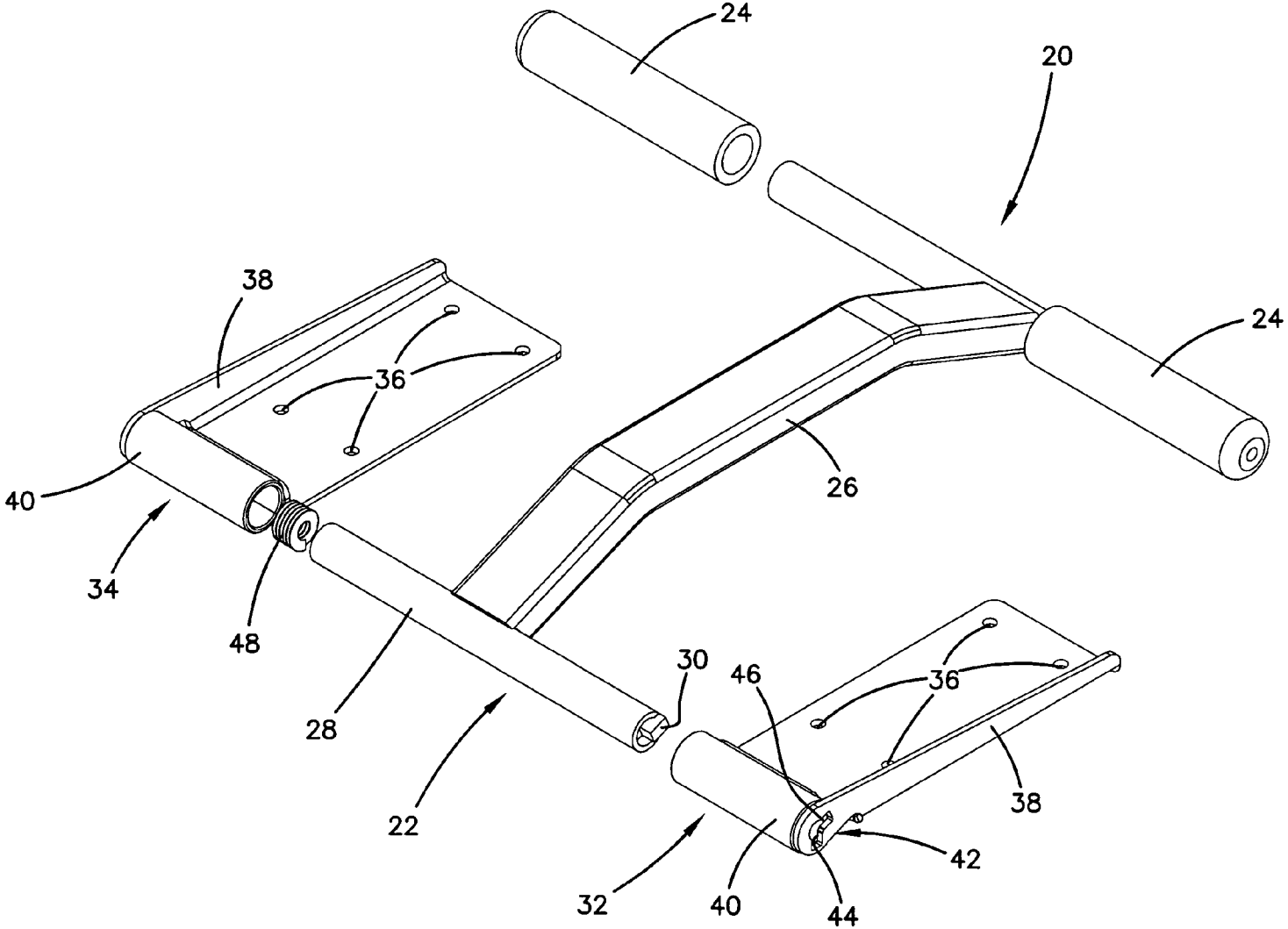
FIG. 7 is an exploded perspective view of the handle assembly shown in FIG. 3.

The room service table 10 also includes a handle assembly, generally designated 20 and shown most clearly in FIGS. 3, 5 and 7. The handle assembly 20 includes a handle portion, generally designated 22, having grips 24, a support portion 26 and a handle hinge portion 28. The support portion 26 includes slight bends to facilitate proper orientation for use and storage. As explained hereinafter, a tab 30 is formed on one end of the hinge portion 28, which acts as a hinge pin. The handle 22 is rotatably mounted relative to the room service table 10. The handle 22 rotates between the use position shown in FIG. 3 and the storage position shown in FIG. 5. It can be appreciated that the handle 22 provides a sturdy pushing device that does not require the user to bend over to grip the handle 22 when at the use position. In the handle storage position, used while the table 10 is stored and when the table 10 is configured to be used for dining, the handle assembly 20 is substantially entirely under the tabletop 12, where it takes up little space and does not cause a safety hazard or interfere with the table's utility as a dining surface.

The handle assembly 20 includes mounting members 32 and 34 that mount to the underside of the tabletop 12 with rivets or other attachment members 50, as shown in FIG. 5. The mounting members 32 and 34 each include side portions 38, mounting poles 36 and hinge body portions 40. The barrel shaped hinge body portions 40 slidably and rotatably retain the hinge portion 28 of the handle 22. Mounting member 32 also includes a slot 42 formed in the side member 38 and aligned with the hinge body 40. The slot 42 includes a first section 44 and a second section 46 that are configured for receiving the tab 30. The slot sections 44 and 46 are configured for engaging the complementary tab 30 in the hinge body portion 40 to retain the handle 22 at the use position and storage position respectively. A spring 48 biases the hinge portion 28 towards the element 32 so that the tab 30 extends into the slot 42. The handle 22 is configured for sliding axially along the axis of the hinge body portions 40 and the hinge portion 28. Although in the embodiment shown, the tab 30 is on the hinge portion 28 and the slot 42 is on the body portion 40, this configuration could be reversed. Moreover, other slot and tab arrangements might also be suitable.

In the use position shown in FIG. 3, the handle 22 extends upward for grasping and pushing by a user. The grip portions 24 are positioned above and to the rear of the tabletop 12 so that a user may comfortably and safely push the table without straining to bend over and grip the handle 22. The tab 30 extends into the first section 44 of the slot 42 and maintains the handle 22 at the use position.

Folding is easily accomplished by sliding the handle 22 axially towards mounting member 34 so that the tab 30 disengages the slot 42. While still pushed toward the mounting portion 34, the handle 22 may be rotated to the storage position shown in FIGS. 5 and 6. When the handle 22 is fully rotated to the storage position, the handle 22 is released so that the spring 48 pushes against the hinge portion 28 and forces the tab 30 towards the slot 32. When properly aligned, the tab 30 seats in the second slot section 46 and the spring 48, slot 42 and tab 30 cooperate to securely maintain the handle 22 out of the way at the storage position. At the storage position, the handle 22 extends substantially parallel to the tabletop 12 and requires little space so that the tables 10 may nest, thereby requiring less space for table storage.

Figure 4:
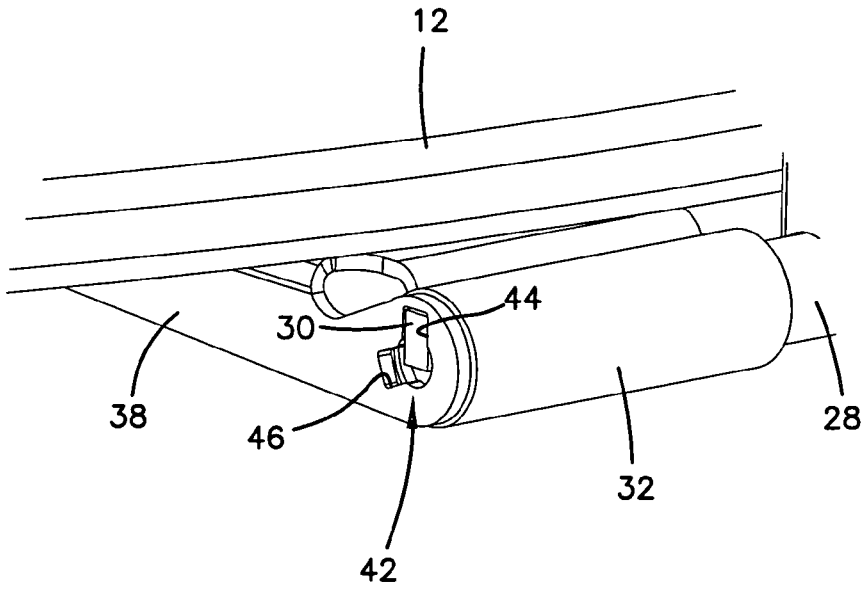
FIG. 4 is a detail perspective view of the detent for the handle assembly shown in FIG. 3.
Figure 6:
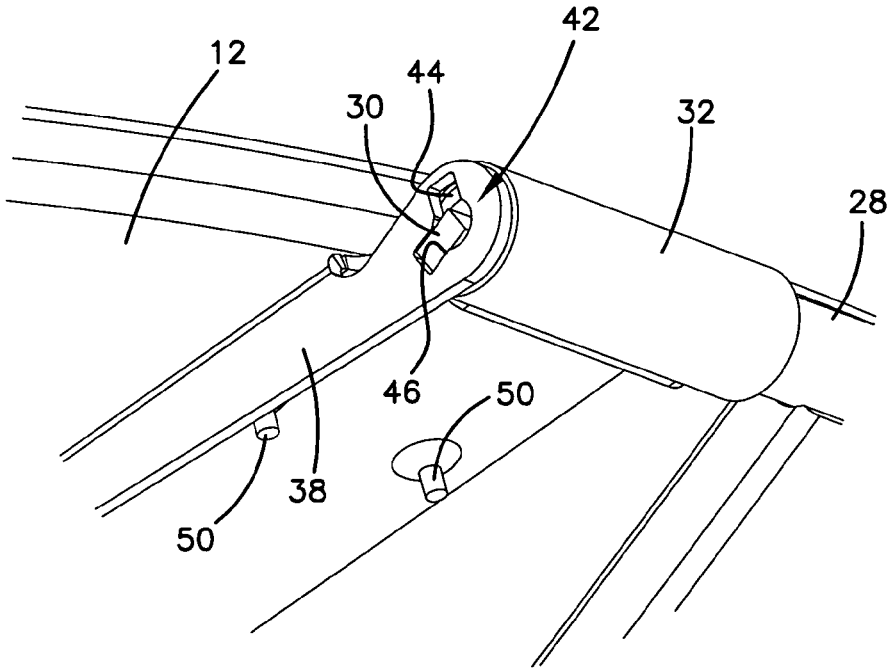
FIG. 6 is a detail perspective view of the detent shown in FIG. 4 with the handle at the position shown in FIG. 5.

To move the handle 22 from the storage position shown in FIGS. 4 and 6 to the use position shown in FIGS. 3 and 5, the process is reversed. From the storage position shown in FIGS. 4 and 6, the handle 22 is slid axially towards the mounting member 34 so that the tab 30 disengages the slot 42. While held at this position, the handle 22 is rotated upward until reaching the position shown in FIG. 3. The handle 22 is then released so that the spring 48 pushes the hinge portion 28 of the handle 22 towards the slot 42, as shown in FIG. 7. When properly aligned, the tab 30 extends into the first slot section 44 and properly aligns the handle 22. The spring 48, detent tab 30 and first slot section 44 cooperate to maintain the handle 22 at the raised use position.

It can be appreciated that the room service table 10 and handle assembly 20 of the present invention provide for an improved, easy to use device. The handle 22 is maintained and locked at both the use position and the storage position. Moreover, no pins or other elements need to be removed and reinserted to lock the handle 22 at either position. The handle 22 is stored securely underneath the tabletop 12 at the use position so that it does not interfere with the utility of the room service table 10. The slot 42 acts to automatically align the handle 22 so that it is properly positioned for both the use position and the storage position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A room service table, comprising:

a frame;

rolling devices supporting the frame;

a tabletop mounted to the frame;

a rotatable push handle assembly rotating between a use position and a storage position, the assembly including:

a handle;

a hinge assembly having a body, a pin and a biasing element, the body mounting to an underside of the tabletop, the pin connected to the handle, wherein the pin slides axially in the body between a first position wherein the handle is locked and a second position wherein the handle freely rotates and the biasing element urges the pin toward the first position; wherein the hinge body comprises an inner wall having a portion extending unobstructed substantially along the length of the pin body.

2. A room service table according to claim 1, further comprising a pin detent locking the handle only at the use position and at the storage position.

3. A room service table according to claim 1, wherein the handle extends above the tabletop at the use position and extends below the tabletop in the storage position.

4. A room service table according to claim 1, further comprising a pin detent locking the handle at the use position and at the storage position, wherein the pin detent comprises a tab on one of the pin or the body and a complementary slot formed in the other of the pin or the body.

5. A room service table according to claim 1, further comprising a pin detent locking the handle at the use position and at the storage position wherein the pin detent comprises a tab extending from an end of the pin and a complementary slot formed in the pin body.

6. A room service table according to claim 5, wherein the slot comprises a first section configured for receiving the tab when the handle assembly is at the use position and a second section configured for receiving the tab when the handle assembly is at the storage position.

7. A room service table according to claim 1, wherein the biasing element is positioned in the body and engages an end of the pin.

8. A room service table according to claim 1, further comprising a pin detent locking the handle only at the use position and at the storage position, wherein the pin detent comprises a tab extending from the pin and a complementary first engagement portion formed in the pin body configured for receiving the tab when the handle assembly is at the use position and a complementary second engagement portion configured for receiving the tab when the handle assembly is at the storage position.

9. A room service table according to claim 1, wherein the hinge assembly pin comprises spaced apart axially aligned first and second pins rotationally mounted in complementary first and second spaced apart hinge bodies, a biasing element mounted in the first hinge body proximate a first end of the first pin opposite the second pin and biasing the first pin toward the second pin.

10. A room service table according to claim 9, wherein the second pin comprises an end portion extending from a second end away from the first pin and engaging a complementary receiving portion formed at an end of the second hinge body.

11. A room service table according to claim 1, wherein the pin body comprises an end portion having a width smaller than the width of the pin body.

12. A room service table according to claim 1, wherein the hinge body comprises a monolithic element.

13. A handle apparatus for a room service table, comprising;

a rotatable push handle assembly rotating between a use position and a storage position, the assembly including:

a handle;

a hinge assembly having spaced apart axially aligned first and second pins connected to the handle and rotationally mounted in complementary first and second spaced apart hinge bodies configured for mounting to an underside of a room service table tabletop, a biasing element mounted in the first binge body proximate a first end of the first pin opposite the second pin; wherein the pin slides axially in the body between a first position wherein the handle is locked and a second position wherein the handle freely rotates and wherein the biasing element biases the first pin toward the second pin.

14. A handle apparatus according to claim 13, further comprising a biasing element biasing the pin toward the first position.

15. A handle apparatus according to claim 14, further comprising a pin detent locking the handle at the use position and at the storage position.

16. A handle apparatus according to claim 14, further comprising a pin detent locking the handle at the use position and at the storage position wherein the pin detent comprises a tab on one of the pin or the body and a complementary slot formed in the other of the pin or the body.

17. A handle apparatus according to claim 14, further comprising a pin detent locking the handle at the use position and at the storage position, wherein the pin detent comprises a tab extending from an end of the pin and a complementary slot formed in the body.

18. A handle apparatus according to claim 17, wherein the slot comprises a first section configured for retaining the tab when the handle is at the use position and a second section configured for retaining the tab when the handle is at the storage position.

19. A handle apparatus according to claim 14, wherein the biasing element is positioned in the body and engages an end of the pin.

20. A handle apparatus according to claim 13, further comprising a pin detent locking the handle at the use position and at the storage position.

21. A handle apparatus according to claim 13, wherein the hinge body comprises an inner wall, wherein the inner wall has a portion extending unobstructed substantially along the length of the pin body.

22. A handle apparatus according to claim 21, wherein the hinge body comprises a smooth inner wall extending substantially along the length of the pin body.

23. A room service table, comprising:

a frame;

wheels supporting the frame;

a tabletop supported on the frame, wherein the table top includes folding side portions, a rotatable push handle assembly mounted below the tabletop and rotating between a use position and a storage position, the handle assembly including:

a handle;

a hinge assembly having: a body and a pin, the hinge body being monolithic and configured for mounting to an underside of a room service table tabletop, the pin connected to the handle, wherein the pin slides axially in the body between a first position wherein the handle is locked and a second position wherein the handle freely rotates; a biasing element biasing the pin toward the first position; a pin detent locking the handle at the use position and at the storage position, wherein the pin detent comprises a tab extending from an end of the pin and a complementary slot formed in the body, the slot comprising a first section configured for retaining the tab when the handle is at the use position and a second section configured for retaining the tab when the handle is at the storage position.

* * * * *